US010997925B2

(12) United States Patent
Choi

(10) Patent No.: US 10,997,925 B2
(45) Date of Patent: May 4, 2021

(54) GATE DRIVER AND ORGANIC LIGHT-EMITTING DISPLAY DEVICE INCLUDING SAME

(71) Applicant: LG Display Co., Ltd., Seoul (KR)

(72) Inventor: Jaeyi Choi, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 16/557,088

(22) Filed: Aug. 30, 2019

(65) Prior Publication Data

US 2020/0074937 A1 Mar. 5, 2020

(30) Foreign Application Priority Data

Sep. 3, 2018 (KR) ..... 10-2018-0104451

(51) Int. Cl.
*G09G 3/3291* (2016.01)
*G09G 3/3266* (2016.01)

(52) U.S. Cl.
CPC ..... *G09G 3/3291* (2013.01); *G09G 3/3266* (2013.01); *G09G 2300/0426* (2013.01); (Continued)

(58) Field of Classification Search
CPC ..... G09G 3/32; G09G 3/3208; G09G 3/3266–3291; G09G 3/3625; G09G 3/3674; G09G 3/3677; G09G 3/3685; G09G 3/3688; G09G 3/3696; G09G 2300/0421; G09G 2300/0426; G09G 2300/043; G09G 2300/0814; G09G 2310/0267; G09G 2310/0278; G09G 2310/0286; G09G 2310/08; G09G 2320/02; G09G 2320/0219; G09G 2320/0223; G09G 2320/0233; G09G 2320/0252; G09G 2320/029; (Continued)

(56) References Cited

U.S. PATENT DOCUMENTS 8,817,943 B2 * 8/2014 Jang ..... G09G 3/3266 377/64
2014/0044228 A1 * 2/2014 Jang ..... G11C 19/287 377/64

(Continued)

FOREIGN PATENT DOCUMENTS

KR 10-2018-0070219 A 6/2018

*Primary Examiner* — Nathan Danielsen
(74) *Attorney, Agent, or Firm* — Seed Intellectual Property Law Group LLP

(57) ABSTRACT

The present disclosure relates to a gate driver and an organic light-emitting display device including same. A gate driver according to an embodiment of the present disclosure includes a plurality of stages. Each of the stages includes: a first pull-up transistor configured to output a carry clock to a first output terminal as a carry signal while a Q node is bootstrapped to a voltage higher than a gate on voltage; a second pull-up transistor configured to output a scan clock to a second output terminal as a scan signal while the Q node is bootstrapped; and holding transistors configured to operate based on a voltage of a QB node, which QB node is charged and discharged in a manner reverse to that of the Q node. The holding transistors are connected to the second output terminal and the Q node, and the holding transistors are electrically isolated from the first output terminal.

18 Claims, 13 Drawing Sheets

(52) U.S. Cl.
CPC ..... *G09G 2300/0814* (2013.01); *G09G 2310/0286* (2013.01); *G09G 2310/08* (2013.01)

(58) Field of Classification Search
CPC ..... G09G 2320/0295; G09G 2320/043; G09G 2320/045
See application file for complete search history.

(56) References Cited

U.S. PATENT DOCUMENTS

2015/0228240 A1* 8/2015 Ahn ..... G09G 3/20 345/213
2018/0138256 A1* 5/2018 Han ..... H01L 27/3262
2018/0337682 A1* 11/2018 Takasugi ..... G09G 3/3241

* cited by examiner

GATE DRIVER AND ORGANIC LIGHT-EMITTING DISPLAY DEVICE INCLUDING SAME

CROSS-REFERENCE TO RELATED APPLICATION(S)

This application claims the benefit of Korea Patent Application No. 10-2018-0104451 filed on Sep. 3, 2018, which is incorporated herein by reference for all purposes as if fully set forth herein.

BACKGROUND

Technical Field

The present document relates to a gate driver and an organic light-emitting display device including the same.

Description of the Related Art

Active matrix type organic light-emitting display devices include spontaneous emission organic light-emitting diodes (hereinafter referred to as "OLED") and have the advantages of a high response speed, high emission efficiency, high luminance and a wide viewing angle.

Organic light-emitting display devices include a gate driver for driving switch elements included in pixels. Gate electrodes of the switch elements are connected to the gate driver through gate lines. The gate driver generates gate signals (scan signals) and sequentially provides the gate signals to the gate lines.

Such organic light-emitting display devices employ an external compensation technique in order to compensate for a driving characteristic deviation between pixels. In addition, with respect to organic light-emitting display devices, research on techniques for realizing a narrow bezel for providing a wider screen to users by increasing an area of a display surface of a display panel, in which images are displayed, instead of minimizing left and right edge areas of the display surface, in which images are not displayed, has been conducted.

BRIEF SUMMARY

The external compensation technique is based on a real-time sensing technique for sensing driving characteristic variations in pixels during screen display. To realize real-time sensing, a gate driver suitable therefor is required. Further, a gate driver is included in a non-display area of a display panel and the non-display area in which the gate driver is located is a bezel area. It is desirable to simplify the gate driver in order to realize a narrow bezel.

Therefore, in various embodiments, the present disclosure provides a gate driver suitable for realization of a narrow bezel and an organic light-emitting display device including the same.

Furthermore, in various embodiments, the present disclosure provides a gate driver capable of performing real-time sensing and an organic light-emitting display device including the same.

A gate driver according to an embodiment of the present disclosure includes a plurality of stages. Each of the stages includes: a first pull-up transistor configured to output a carry clock to a first output terminal as a carry signal while a Q node is bootstrapped to a voltage higher than a gate on voltage; a second pull-up transistor configured to output a scan clock to a second output terminal as a scan signal while the Q node is bootstrapped; and holding transistors configured to operate based on a voltage of a QB node that is configured to be charged and discharged in a manner reverse to charging and discharging of the Q node. The holding transistors are connected to the second output terminal and the Q node, and the holding transistors are electrically isolated from the first output terminal.

In another embodiment, the present disclosure provides an organic light-emitting display device that includes a gate driver having a plurality of stages. Each of the stages includes: a first pull-up transistor configured to output a carry clock to a first output terminal as a carry signal while a Q node is bootstrapped to a voltage higher than a gate on voltage; a second pull-up transistor configured to output a scan clock to a second output terminal as a scan signal while the Q node is bootstrapped; and holding transistors configured to operate based on a voltage of a QB node that is configured to be charged and discharged in a manner reverse to charging and discharging of the Q node. The holding transistors are connected to the second output terminal and the Q node, and the holding transistors are electrically isolated from the first output terminal. The organic light-emitting display device further includes a plurality of pixels connected to the gate driver through a plurality of gate lines.

BRIEF DESCRIPTION OF THE SEVERAL VIEWS OF THE DRAWINGS

The accompanying drawings, which are included to provide a further understanding of the disclosure and are incorporated in and constitute a part of this specification, illustrate embodiments of the disclosure and together with the description serve to explain the principles of the disclosure. In the drawings.

DETAILED DESCRIPTION

Figure 1:
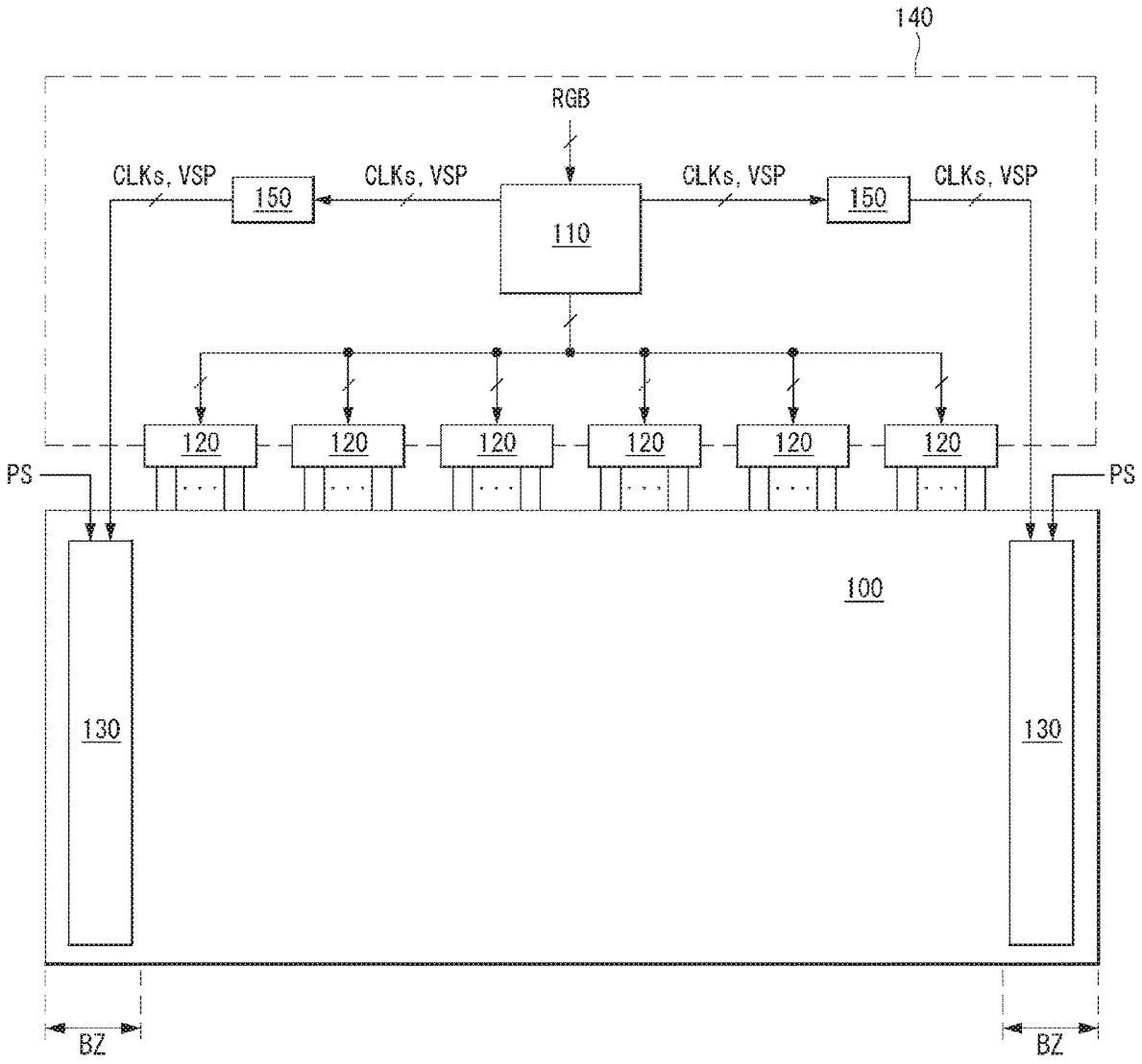
FIG. 1 is a diagram showing an organic light-emitting display device according to an embodiment of the present disclosure.

The advantages, features and methods for accomplishing the same of the present disclosure will become more apparent through the following detailed description with respect to the accompanying drawings. However, the present disclosure is not limited by embodiments described blow and is implemented in various different forms, and the embodiments are provided so that this disclosure will be thorough and complete, and will fully convey the scope of the disclosure to those skilled in the art.

Shapes, sizes, ratios, angles, numbers, etc., shown in the figures to describe embodiments of the present disclosure are exemplary and thus are not limited to particulars shown in the figures. Like numbers refer to like elements throughout the specification. It will be further understood that when the terms "include", "have" and "comprise" are used in this specification, other parts may be added unless "~ only" is used. An element described in the singular form is intended to include a plurality of elements unless context clearly indicates otherwise.

In interpretation of a component, the component is interpreted as including an error range unless otherwise explicitly described.

It will be understood that, when an element is referred to as being "on" or "under" another element, it can be "directly" on or under another element or can be "indirectly" formed such that an intervening element is also present.

In the following description of the embodiments, "first" and "second" are used to describe various components, but such components are not limited by these terms. The terms are used to discriminate one component from another component. Accordingly, a first component mentioned in the following description may be a second component within the technical spirit of the present disclosure.

Although a pixel circuit and a gate driver formed on a substrate of a display panel may be implemented as TFTs in an n-type metal oxide semiconductor field effect transistor (MOSFET) structure in this specification, the present disclosure is not limited thereto and they may be implemented as TFTs in a p-type MOSFET structure. A TFT is a three-electrode element including a gate, a source and a drain. The source is an electrode that provides carriers to the transistor. Carriers flow from the source in the TFT. The drain is an electrode from which carriers flow to the outside of the TFT. That is, carriers flow from the source to the drain in a MOSFET. In the case of an n-type TFT (NMOS), a source voltage is lower than a drain voltage such that electrons can flow from the source to the drain because carriers are electrons. Since electrons flow from the source to the drain in the n-type TFT, current flows from the drain to the source. On the other hand, in the case of a p-type TFT (PMOS), a source voltage is higher than a drain voltage such that holes can flow from the source to the drain because carriers are holes. Since holes flow from the source to the drain in the p-type TFT, current flows from the source to the drain. It is noted that the source and the drain of the MOSFET are not fixed. For example, the source and the drain of the MOSFET may be changed according to an applied voltage. Accordingly, one of the source and the drain is referred to as a first electrode and the other is referred to as a second electrode in description of embodiments of this specification.

Hereinafter, embodiments of the specification will be described in detail with reference to the attached drawings. In the following embodiments, description focuses on an organic light-emitting display device including an organic light-emitting material as a display device.

In the following description, if a detailed description of known techniques associated with the present disclosure would unnecessarily obscure the gist of the present disclosure, detailed description thereof will be omitted.

In the following description, "front stages" refer to stages which are located above a reference stage and generate gate signals with phases ahead of that of a gate signal output from the reference stage. In addition, "rear stages" refer to stages which are located under the reference stage and generate gate signals with phases delayed from that of a gate signal output from the reference stage. In the following description, switch elements constituting a gate driver of the present disclosure may be implemented as at least one of an oxide element, an amorphous silicon element and a polysilicon element. In addition, activation of a specific node means that the node is charged with a gate on voltage and deactivation of a specific node means that the potential of the node is discharged to a gate off voltage.

Figure 2:
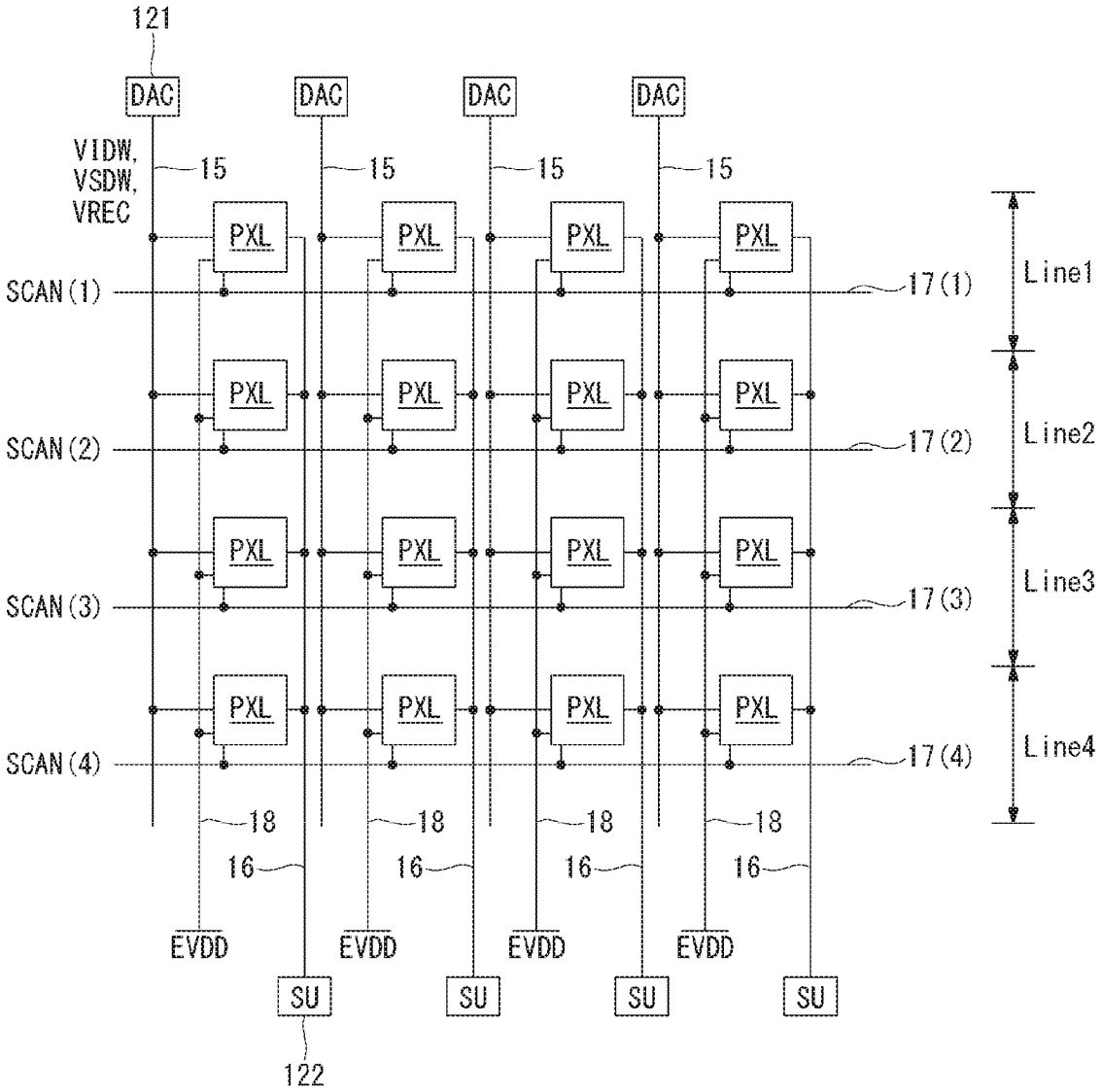
FIG. 2 is a diagram showing a pixel array included in a display panel of FIG. 1.
Figure 3:
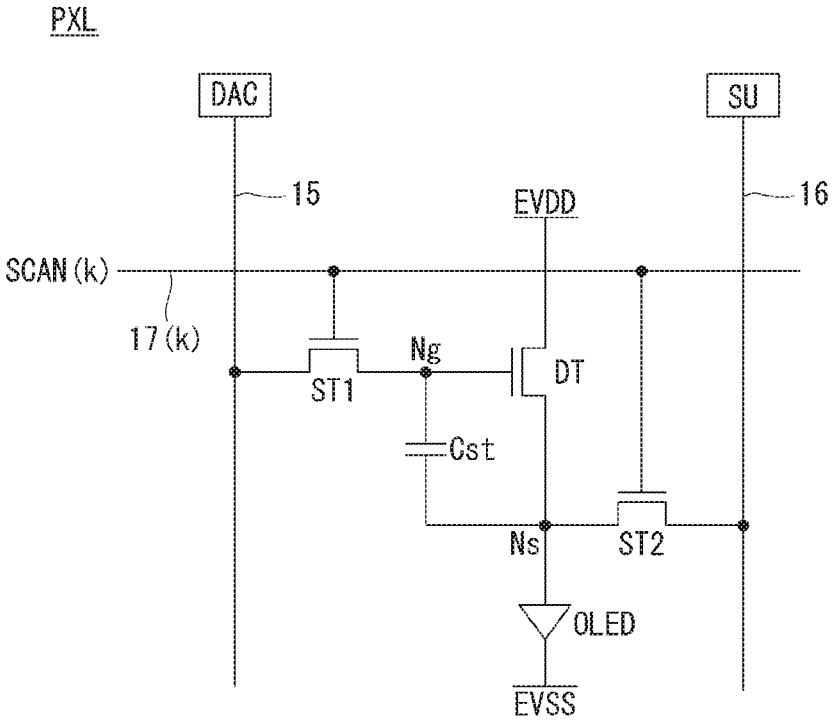
FIG. 3 is a diagram showing a structure of one pixel included in the pixel array of FIG. 2.
Figure 4:
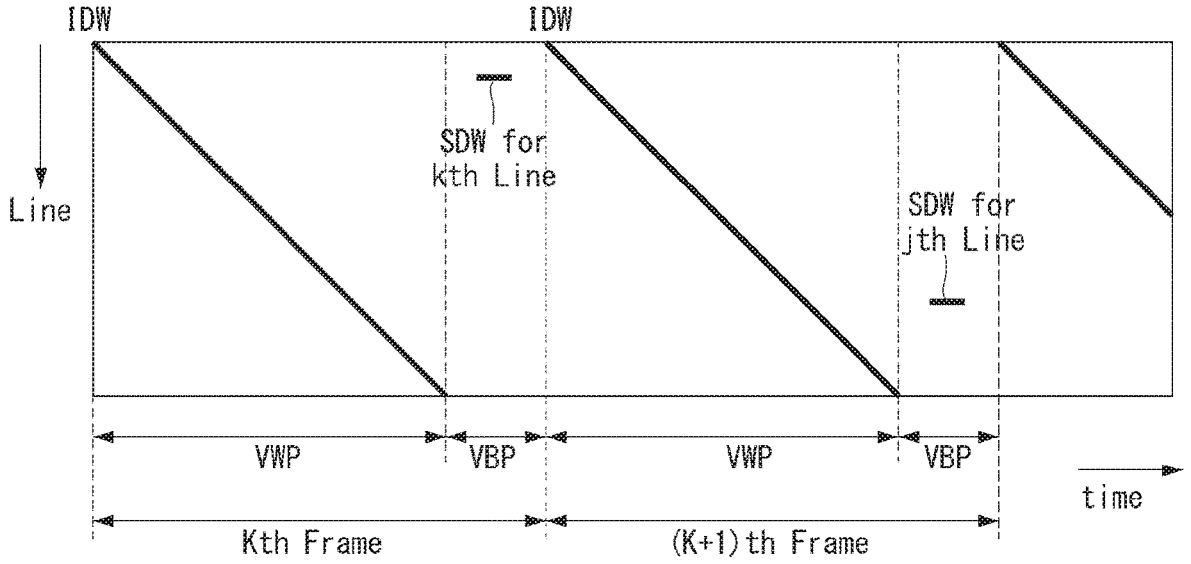
FIG. 4 is a diagram showing IDW timing and SDW timing.

FIG. 1 shows an organic light-emitting display device according to an embodiment of the present disclosure. FIG. 2 is a diagram showing a pixel array included in a display panel of FIG. 1. FIG. 3 is a diagram showing a structure of one pixel included in the pixel array of FIG. 2. FIG. 4 is a diagram showing timings at which IDW and SDW are performed.

Referring to FIGS. 1 to 3, the organic light-emitting display device of the present disclosure includes a display panel 100, a data driver, a gate driver and a timing controller 110.

The display panel 100 may include a plurality of data lines 15, reference voltage lines 16 and a plurality of gate lines 17. In addition, pixels PXL may be disposed at intersections of the data lines 15, the reference voltage lines 16 and the gate lines 17. Further, the pixels PXL arranged in a matrix form may form the pixel array shown in FIG. 2 in a display area of the display panel 100.

In the pixel array, the pixels PXL may be divided into lines in one direction. For example, the pixels PXL may be divided into a plurality of pixel lines Line 1 to Line 4 in a direction in which the gate lines extend (or horizontal direction). Here, a pixel line means a set of neighboring pixels PXL arranged in a horizontal direction rather than a physical signal line. Accordingly, pixels PXL constituting the same pixel line can be connected to the same gate line 17.

In the pixel array, each pixel PXL can be connected to a digital-to-analog converter (DAC) 121 through a data line 15 and connected to a sensing unit (SU) 122 through a reference voltage line 16. The reference voltage line 16 may be connected to the DAC 121 in order to provide a reference voltage. Although the DACs 121 and the sensing units SU may be embedded in the data driver, the present disclosure is not limited thereto.

In the pixel array, each pixel PXL may be connected to a high-voltage pixel power supply EVDD through a power line 18. Further, each pixel PXL may be connected to the gate driver through a gate line 17.

Each pixel PXL may be implemented as shown in FIG. 3. A pixel PXL disposed in a k-th (k is an integer) pixel line includes a driving thin film transistor (TFT) DT, a storage capacitor Cst, a first switch TFT ST1 and a second switch TFT ST2, and the first switch TFT ST1 and the second switch TFT ST2 may be connected to the same gate line 17(*k*). The TFTs may be implemented as p-type, n-type or a hybrid type of the p-type and the n-type. Further, semiconductor layers of the TFTs may include amorphous silicon, polysilicon or an oxide.

An OLED includes an anode connected to a source node Ns, a cathode connected to an input terminal of a low-voltage pixel power supply EVSS, an organic compound layer disposed between the anode and the cathode. The driving TFT DT controls a driving current flowing through the OLED according to a voltage difference between a gate node Ng and the source node Ns. The driving TFT DT includes a gate electrode connected to the gate node Ng, a first electrode connected to an input terminal of the high-voltage pixel power supply EVDD, and a second electrode connected to the source node Ns. The storage capacitor Cst is connected between the gate node Ng and the source node Ns and stores a gate-source voltage of the driving TFT DT.

The first switch TFT ST1 allows current to flow between the data line 15 and the gate node Ng according to a scan signal SCAN(k) to apply a data voltage charged in the data line 15 to the gate node Ng. The first switch TFT ST1 includes a gate electrode connected to the gate line 17(*k*), a first electrode connected to the data line 15 and a second electrode connected to the gate node Ng. The second switch TFT ST2 allows current to flow between the reference voltage line 16 and the source node Ns according to the scan signal SCAN(k) to apply a reference voltage charged in the reference voltage line 16 to the source node Ns or to transfer a voltage variation in the source node Ns according to a pixel current to the reference voltage line 16. The second switch TFT ST2 includes a gate electrode connected to the gate line 17(*k*), a first electrode connected to the reference voltage line 16 and a second electrode connected to the source node Ns.

The number of gate lines 17 connected to each pixel PXL may depend on the structure of the pixel PXL. For example, in the case of a 2-scan pixel structure in which the first switch TFT ST1 and the second switch TFT ST2 are differently driven, the number of gate lines 17 connected to each pixel PXL is 2. In the 2-scan pixel structure, each gate line 17 includes a first gate line to which a scan signal is applied and a second gate line to which a sense signal is applied. On the other hand, in the case of a 1-scan pixel structure in which the first switch TFT ST1 and the second switch TFT ST2 are equally driven, one gate line 17 is connected to each pixel PXL. Although the 1-scan pixel structure will be exemplified in the following for convenience of description, the technical spirit of the specification is not limited to the pixel structure or the number of gate lines.

The timing controller 110 can generate a source timing control signal for controlling an operation timing of the data driver and a gate timing control signal for controlling an operation timing of the gate driver on the basis of timing signals such as a vertical synchronization signal Vsync, a horizontal synchronization signal Hsync and a data enable signal DE input from a host system (not shown). The gate timing control signal may include a gate start signal, gate shift clocks, a pixel line selection signal, a sensing start signal, and the like. The source timing control signal includes a source start pulse, a source sampling clock, a source output enable signal, and the like. The source start pulse controls a data sampling start timing of the data driver. The source sampling clock controls a data sampling timing on the basis of a rising or falling edge thereof. The source output enable signal controls an output timing of the data driver.

The timing controller 110 can control a displaying operation timing and a sensing operation timing for pixel lines of the display panel 100 on the basis of the gate/source timing control signals such that driving characteristics of pixels can be sensed in real time during image display.

Here, a sensing operation is an operation of writing data for sensing to pixels PXL disposed in a specific pixel line to sense driving characteristics of the corresponding pixels and updating compensation values for compensating for driving characteristic variations in the corresponding pixels PXL on the basis of the sensing result. Hereinafter, the sensing operation is referred to as sensing data writing (SDW).

A displaying operation is an operation of writing input image data RGB to pixel lines in one frame to reproduce an input image on a display surface of the display panel 100. Hereinafter, the display operation is referred to as image data writing (IDW).

The timing controller 110 may realize IDW in a vertical active period VWP and realize SDW in a vertical blank period VBP in which IDW is not performed in one frame, as shown in FIG. 4. The timing controller 110 outputs the aforementioned gate timing control signal to the gate driver for IDW and SDW.

The timing controller 110 may realize SDW for one pixel line in one frame, as shown in FIG. 4. Pixel lines for which SDW is performed may change per frame sequentially or non-sequentially. The luminance of pixel lines for which SDW is performed is lower than those of other pixel lines and thus may be visually recognized as line dim. Accordingly, the timing controller 110 may randomly set target pixel lines of SDW in advance to temporally and spatially distribute line dim such that the line dim becomes less visible.

The timing controller 110 may correct image data RGB such that driving characteristic deviations of pixels are compensated on the basis of sensing results according to SDW and then transmit the corrected image data RGB to source drive ICs 120. The timing controller 110 outputs sensing data which has been internally generated (or set to a specific value in advance). The sensing data is used to cause a specific pixel current to flow through pixels PXL of a target pixel line during SDW. Sensing data to be written to R, G and B pixels PXL may be set differently in consideration of emission efficiency differences between R, G and B OLEDs.

The data driver includes a plurality of source drive ICs 120. The source drive ICs 120 receive image data RGB from the timing controller 110. The source drive ICs 120 converts the image data RGB into gamma compensation voltages to generate data voltages in response to the source timing control signal from the timing controller 110 and provides the data voltages to the data lines of the display panel 100 in synchronization with scan signals. The source drive ICs may be connected to the data lines of the display panel 100 through a chip on glass (COG) process or a tape automated bonding (TAB) process.

Each of the source drive ICs 120 includes a plurality of DACs 121 and a plurality of sensing units (SUs) 122. Each DAC 121 converts input image data RGB into a data voltage VIDW for IDW and converts sensing data into a data voltage VSDW for SDW on the basis of a data timing control signal DDC from the timing controller 110. In addition, the DAC 121 generates a reference voltage to be applied to pixels PXL.

The DAC 121 outputs the data voltage VIDW for IDW to the data lines 15 in synchronization with a scan signal SCAN and outputs the reference voltage to the reference voltage lines 16 in synchronization with a scan signal SCAN in order to realize IDW.

The DAC 121 sets up sensing target pixel lines by outputting the data voltage VSDW for SDW to the data lines 15 in synchronization with a scan signal SCAN and outputting the reference voltage to the reference voltage lines 16 in synchronization with a scan signal SCAN in order to realize SDW. The sensing units (SUs) 122 sense a pixel current flowing through pixels PXL of the sensing target pixel lines through the reference voltage lines 16. After sensing ends, the DAC 121 outputs a recovery voltage VREC for SDW to the data lines 15 in synchronization with a scan signal SCAN to restore display states of the sensing target pixel lines to states immediately before sensing. The recovery voltage VREC for SDW may be the data voltage VIDW for IDW.

The gate driver includes a gate shift register 130 connected to the gate lines and a level shifter 150 for boosting a voltage level of a signal output from the timing controller 110 and supplying the signal to the gate shift register 130.

The level shifter 150 boosts a transistor-transistor-logic (TTL) level voltage of the gate timing control signal input from the timing controller 110 to a gate on voltage and a gate off voltage that can switch TFTs formed in the pixel array of the display panel 100. In addition, the level shifter 150 provides the level-shifted gate timing control signal to the gate shift register 130.

The gate shift register 130 generates a scan signal SCAN for IDW and a scan signal SCAN for SDW on the basis of the gate timing control signal DDC from the timing controller 110. The gate shift register 130 sequentially provides the scan signal SCAN for IDW to all gate lines 17 during a vertical active period VWP and provides the scan signal SCAN for SDW to specific gate lines 17 included in sensing target pixel lines during a vertical blank period VBP.

The gate shift register 130 may be directly formed on the substrate of the display panel 100 through a GIP (Gate In Panel). The gate shift register 130 is formed in an area (i.e., a bezel area (BZ)) in which images are not displayed in the display panel 100. The gate shift register 130 may be formed in a first bezel area BZ and a second bezel area BZ of the display panel 100 in order to minimize gate signal distortion caused by RC delay.

The gate shift register 130 includes a plurality of stages which output gate signals on the basis of N-phase clocks. Each stage connects holding transistors to a scan output terminal and a Q node to stabilize a voltage of the scan output terminal and a voltage of the Q node. On the other hand, each stage removes holding transistors from a carry output terminal to simplify a stage circuit configuration and reduce an area in which the stage is mounted. Each stage complements a side effect caused by removal of the holding transistors from the carry output terminal by applying a diode input structure as a carry input structure. Further, each stage can further simplify the stage circuit configuration by simultaneously controlling a first pull-up transistor that outputs a carry signal and a second pull-up transistor that outputs a scan signal using the same Q node. Moreover, each stage may further include a sensing line selector to be suited to SDW. This stage configuration will be described in detail with reference to FIGS. 10 to 12.

Figure 5:
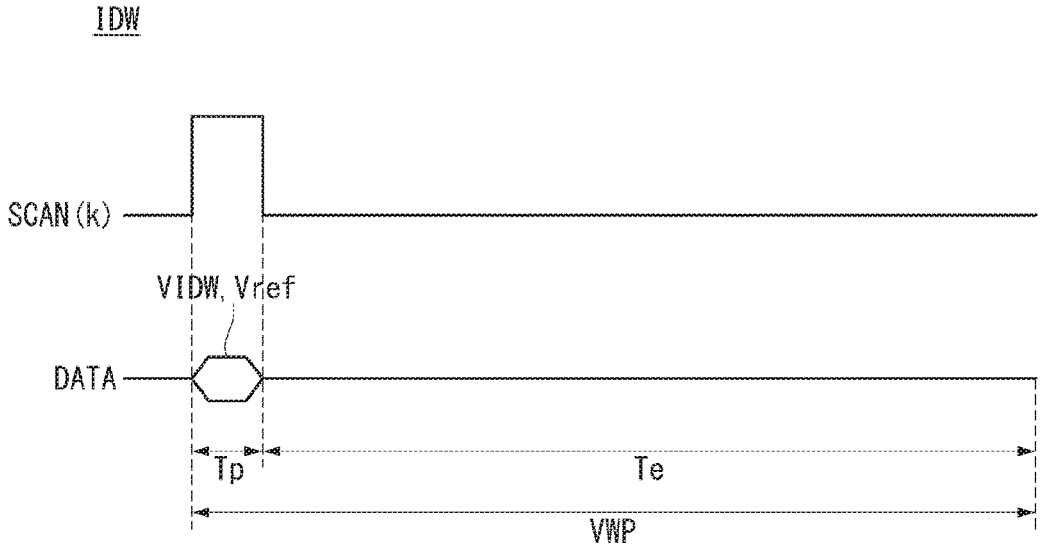
FIG. 5 is a diagram showing a scan signal for IDW and a data signal synchronized with the scan signal.
Figure 6A:
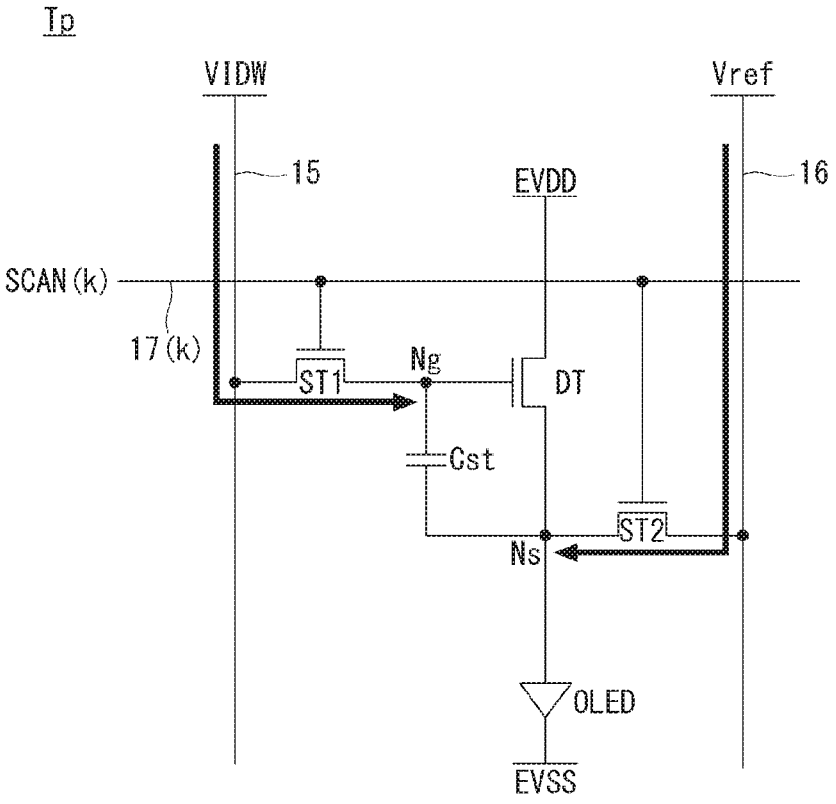
FIG. 6A is an equivalent circuit diagram of a pixel corresponding to a programming period of FIG. 5.

FIG. 5 is a diagram showing a scan signal for IDW and a data signal synchronized with the scan signal. FIG. 6A is an equivalent circuit diagram of a pixel corresponding to a programming period of FIG. 5 and FIG. 6B is an equivalent circuit diagram of a pixel corresponding to an emission period of FIG. 5.

FIG. 5 illustrates a scan signal SCAN(k) and a data signal for IDW applied to pixels PXL of a k-th pixel line. The data signal includes a data voltage VIDW for IDW and a reference voltage Vref. Referring to FIG. 5, one frame for IDW includes a programming period Tp in which a voltage between a gate node Ng and a source node Ns is set to be suited to a pixel current for displaying images and an emission period Te in which OLEDs emit light according to the pixel current.

Referring to FIGS. 5 and 6A, the first switch TFT ST1 of the pixel is turned on according to the scan signal SCAN(k) for IDW at a gate on voltage GON to apply the data voltage VIDW for IDW to the gate node Ng in the programming period Tp. The second switch TFT ST2 of the pixel is turned on according to the scan signal SCAN(k) for IDW at the gate on voltage GON to apply the reference voltage Vref to the source node Ns in the programming period Tp. Accordingly, the voltage between the gate node Ng and the source node Ns of the pixel is set to be suited to a desired pixel current in the programming period Tp.

Figure 6B:
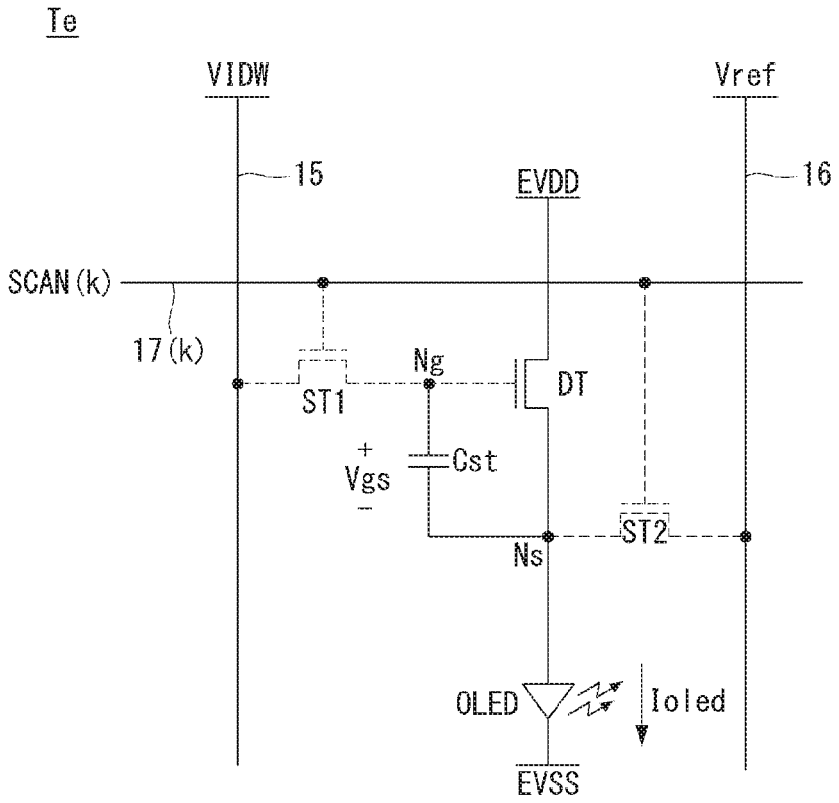
FIG. 6B is an equivalent circuit diagram of a pixel corresponding to an emission period of FIG. 5.

Referring to FIGS. 5 and 6B, the first switch TFT ST1 and the second switch TFT ST2 of the pixel is are turned off in the emission period Te. The voltage Vgs between the gate node Ng and the source node Ns which has been set in the pixel in the programming period Tp is maintained in the emission period Te. Since the voltage Vgs between the gate node Ng and the source node Ns is higher than a threshold voltage of the driving TFT DT of the pixel, a pixel current Ioled flows through the driving TFT DT of the pixel during the emission period Te. The electric potential of the gate node Ng and the electric potential of the source node Ns are boosted while maintaining the voltage Vgs between the gate node Ng and the source node Ns according to the pixel current Ioled in the emission period Te. When the electric potential of the source node Ns is boosted to an operating point level of the OLED, the OLED of the pixel emits light.

Figure 7:
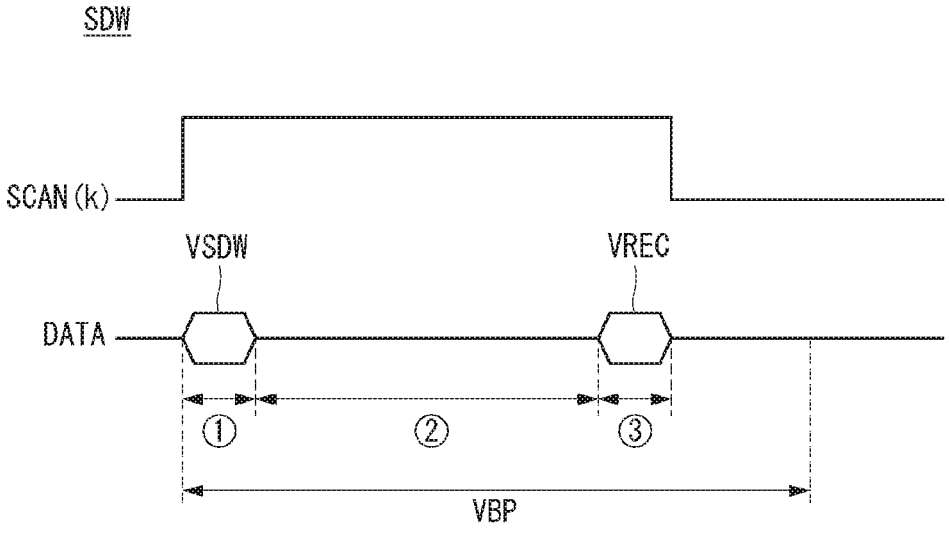
FIG. 7 is a diagram showing a scan signal for SDW and a data signal synchronized with the scan signal.
Figure 8A:
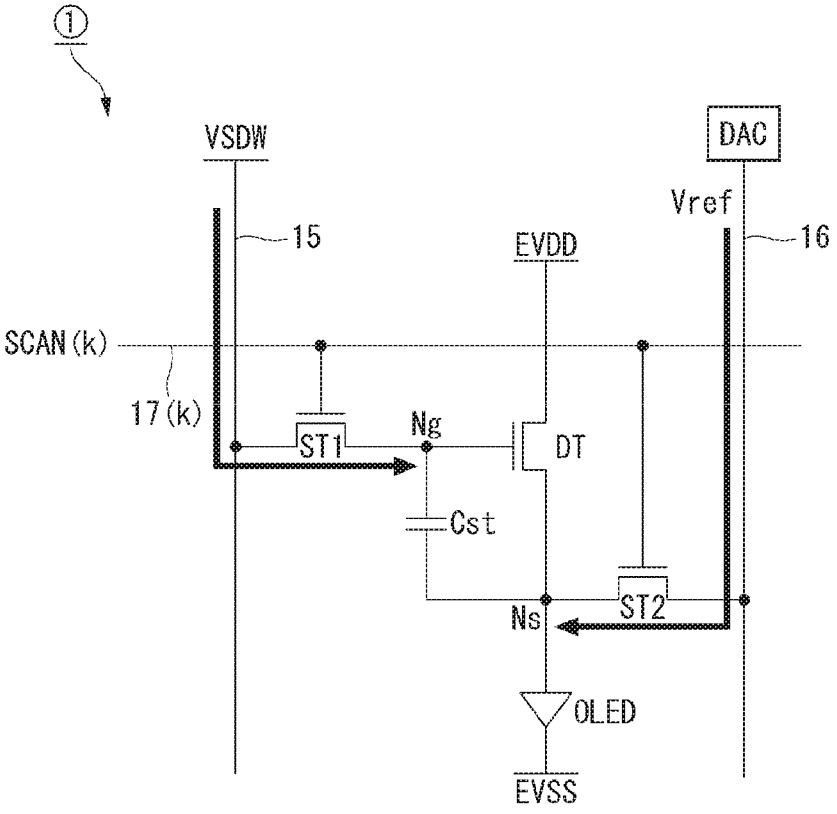
FIG. 8A is an equivalent circuit diagram of a pixel corresponding to a setup period of FIG. 7.
Figure 8B:
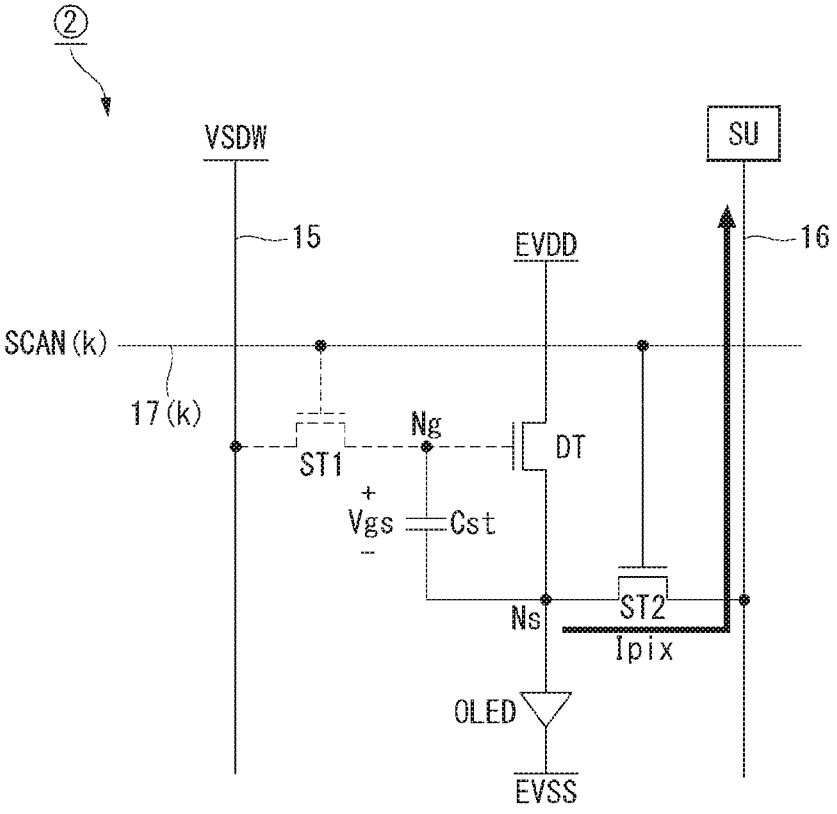
FIG. 8B is an equivalent circuit diagram of a pixel corresponding to a sensing period of FIG. 7.
Figure 8C:
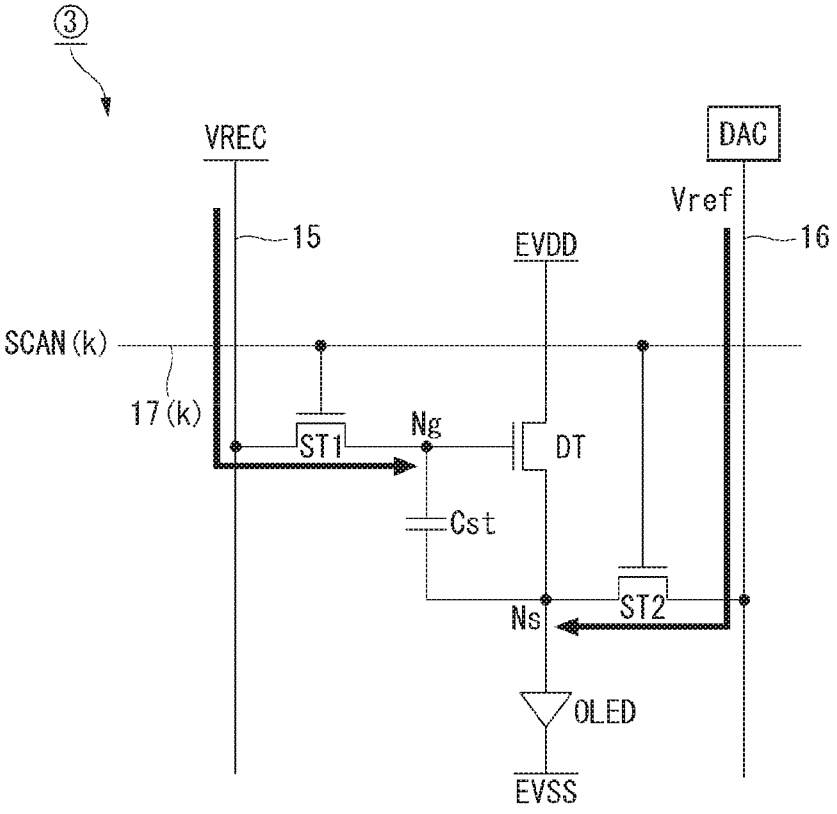
FIG. 8C is an equivalent circuit diagram of a pixel corresponding to a reset period of FIG. 7.

FIG. 7 is a diagram showing a scan signal for SDW and a data signal synchronized with the scan signal. FIG. 8A is an equivalent circuit diagram of a pixel corresponding to a setup period of FIG. 7. FIG. 8B is an equivalent circuit diagram of a pixel corresponding to a sensing period of FIG. 7. FIG. 8C is an equivalent circuit diagram of a pixel corresponding to a reset period of FIG. 7.

FIG. 7 illustrates a scan signal SCAN(k) and a data signal for SDW applied to pixels PXL of the k-th pixel line. The data signal includes a data voltage VSDW for SDW, a recovery voltage VREC for SDW and a reference voltage Vref. Referring to FIG. 7, a vertical blank period VBP for SDW includes a setup period ① in which the voltage between the gate node Ng and the source node Ns is set to be suited to a pixel current for sensing, a sensing period ② in which the pixel current is sampled, and a reset period ③ in which the voltage between the gate node Ng and the source node Ns is restored to the state immediately before the setup period ①.

Referring to FIGS. 7 and 8A, the first switch TFT ST1 of the pixel is turned on according to the scan signal SCAN(k) for SDW at the gate on voltage GON to apply the data voltage VSDW for SDW to the gate node Ng in the setup period ①. The second switch TFT ST2 of the pixel is turned on according to the scan signal SCAN(k) for SDW at the gate on voltage GON to apply the reference voltage Vref to the source node Ns in the setup period ①. Accordingly, the voltage between the gate node Ng and the source node Ns is set to be suited to a pixel current for sensing in the setup period ①.

Referring to FIGS. 7 and 8B, the first switch TFT ST1 of the pixel is turned off but the second switch TFT ST2 maintains in a turn-on state in the sensing period ② In addition, the reference voltage line 16 is disconnected from the DAC and is connected to the sensing unit SU. The sensing unit SU samples a pixel current Ipix for sensing input through the second switch TFT ST2 and the reference voltage line 16 in the sensing period ②.

Referring to FIGS. 7 and 8C, the first switch TFT ST1 of the pixel is turned on according to the scan signal SCAN(k) for SDW at the gate on voltage GON to apply a recovery data voltage VREC to the gate node Ng in the reset period ③. The recovery data voltage VREC may be a data voltage for IDW. The reference voltage line 16 is re-connected to the DAC and the second switch TFT ST2 of the pixel is turned on according to the scan signal SCAN(k) for SDW at the gate on voltage GON to apply the reference voltage Vref to the source node Ns in the reset period ③. Accordingly, the voltage between the gate node Ng and the source node Ns is restored to the state immediately before SDW, that is, IDW state in the reset period ③.

Figure 9:
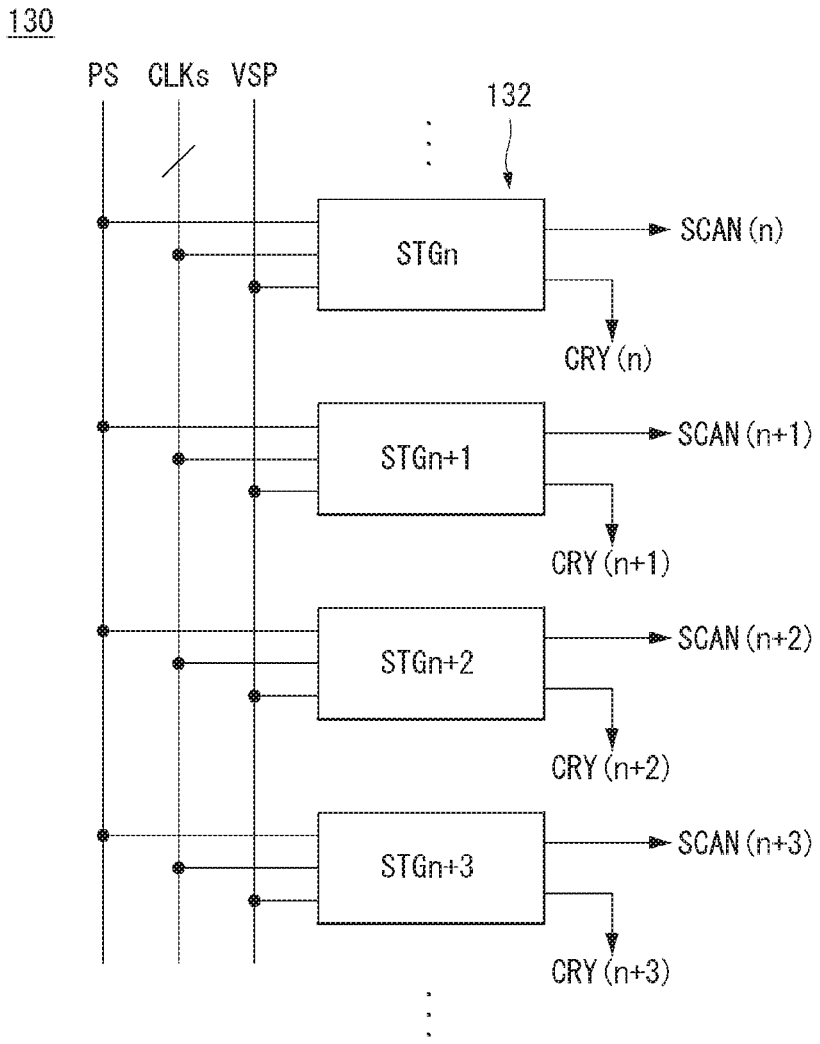
FIG. 9 is a diagram showing connection between signal lines and stages included in a gate shift register.

FIG. 9 is a diagram showing connection between signal lines and stages 132 included in the gate shift register 130.

Referring to FIG. 9, the gate shift register 130 according to an embodiment of the present disclosure includes a plurality of dependently connected stages 132. The stages 132 may be GIP elements formed through a GIP (Gate driver In Panel) method. At least one upper dummy stage may be further provided before the uppermost stage and at least one lower dummy stage may be further provided after the lowermost stage. However, the present disclosure is not limited thereto.

The stages 132 generate gate signals on the basis of a power supply voltage PS, a gate start signal VSP and gate shift clocks CLKs input through signal lines. Gate signals may include scan signals SCAN(n) to SCAN(n+3) and carry signals CRY(n) to CRY(n+3).

The stages 132 generate scan signals SCAN(n) and provides the scan signals SCAN(n) to the gate lines 17 of the display panel 100. The stages 132 can prevent carry signals from being distorted due to gate load by independently generating the carry signals CRY(n) to CRY(n+3). The stages 132 generate the carry signals CRY(n) to CRY(n+3), provide the carry signals to following stages as preceding carry signals and provide the carry signals to preceding stages as following carry signals. A preceding carry signal is an internal start signal for activating a Q node and a following carry signal is an internal reset signal for deactivating the Q node.

Each stage 132 activates the operation of the Q node according to a gate start signal VSP or a preceding carry signal applied to a carry input terminal for each frame. The preceding carry signal is a carry signal CRY applied from one of preceding stages. Each stage 132 deactivates the operation of the Q node according to a following carry signal applied to the carry input terminal for each frame. The following carry signal is a carry signal CRY applied from one of following stages.

The gate start signal VSP and the gate shift clocks CLKs are signals commonly supplied to the stages 132. The gate shift clocks CLKs implemented as N-phase (N is a natural number) clocks having different phases may include N-phase carry clocks and N-phase scan clocks.

The scan clocks are clock signals for generating the scan signals SCAN(n) to SCAN(n+3) and carry clocks are clock signals for generating the carry signals CRY(n) to CRY(n+3). The scan clocks swing between a gate on voltage and a gate off voltage to be synchronized with the scan signals SCAN(n) to SCAN(n+3). The carry clocks swing between the gate on voltage and the gate off voltage to be synchronized with the carry signals CRY(n) to CRY(n+3).

The gate shift clocks CLKs may be overlap-driven in order to secure sufficient charging time during high-speed operation. Gate on voltage periods of the gate shift clocks CLKs can overlap by a predetermined time according to overlap driving.

Each stage 132 may be provided with the power supply voltage PS from an external power supply unit (not shown). The power supply voltage PS includes a high power supply voltage and a low power supply voltage. The high power supply voltage may be set to the gate on voltage, for example, 28V. The low power supply voltage may be set to a plurality of gate off voltages, for example, −6V and −12V, in order to restrain leakage current of transistors belonging to each stage 132. In this case, scan clocks can swing between −6V and 12V and carry clocks can swing between −12V and 12V. In other words, the swing width of the carry clocks may be greater than that of the scan clocks. In addition, the swing width of the carry signals CRY(n) to CRY(n+3) may be greater than that of the scan signals SCAN(n) to SCAN(n+3). This is effective to restrain deterioration of a pull-down transistor having a gate electrode connected to a QB node in each stage.

Figure 10:
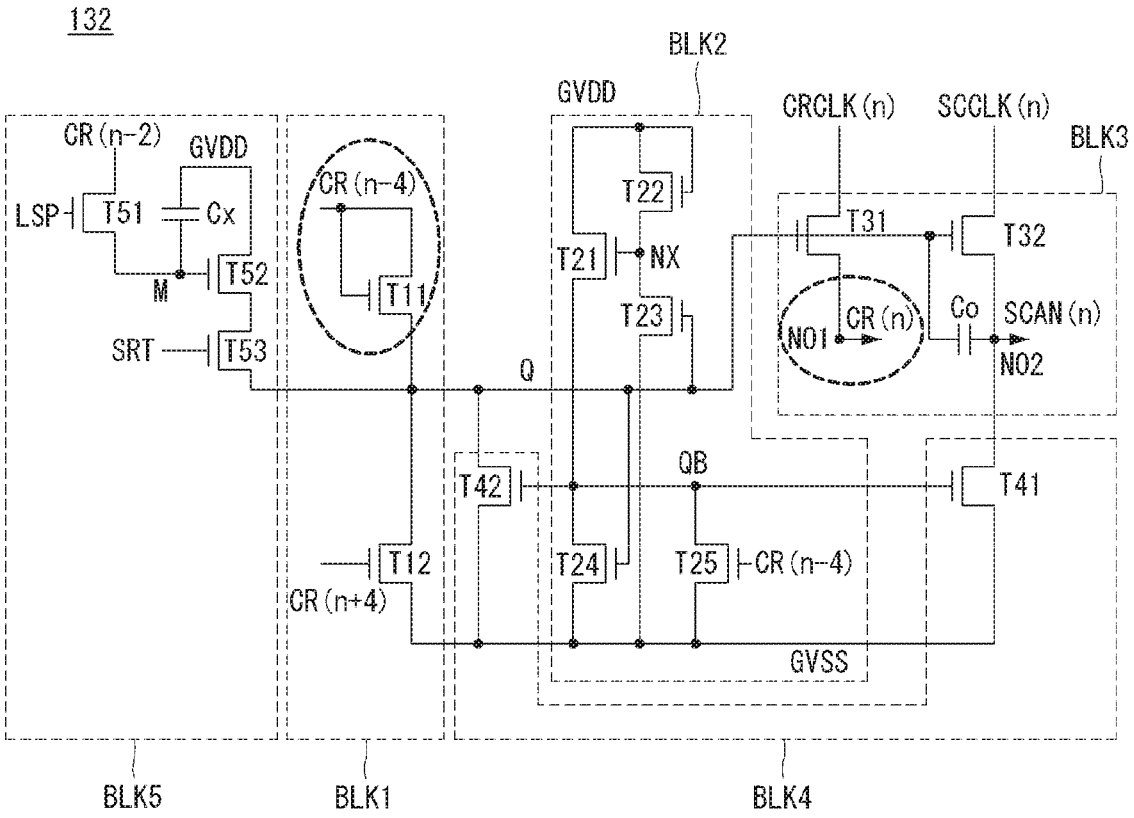
FIG. 10 is a circuit diagram of one stage included in the gate shift register of FIG. 9.
Figure 11:
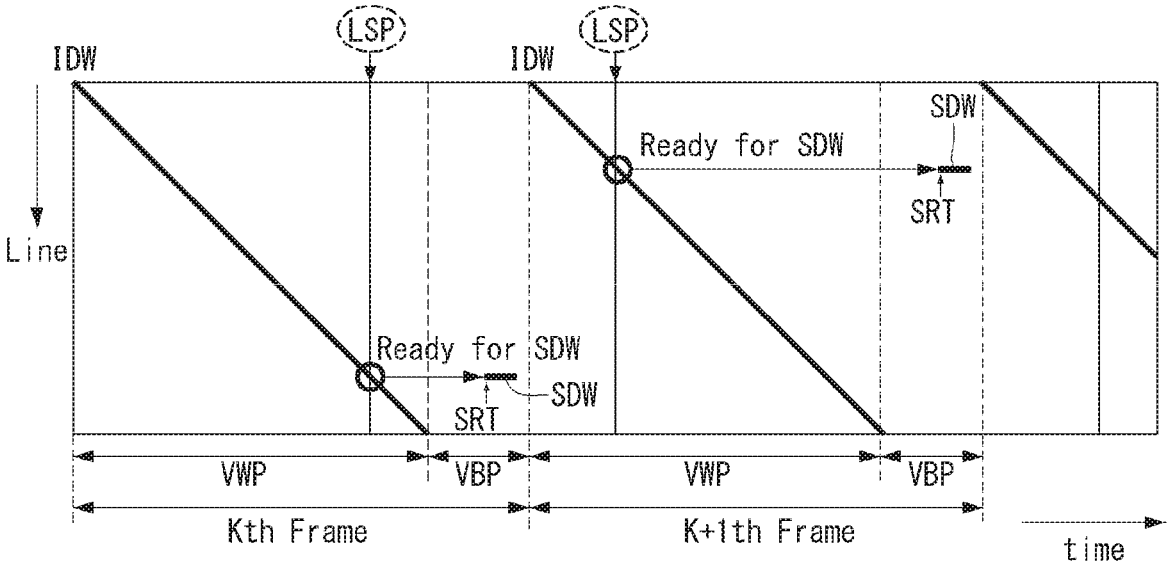
FIG. 11 is a diagram for describing an operation of a sensing line selector included in FIG. 10.

FIG. 10 is a circuit diagram showing one stage 132 included in the gate shift register 130 of FIG. 9.

Referring to FIG. 10, an n-th stage 132 generates an n-th carry signal CR(n), provides the n-th carry signal CR(n) to one of preceding stages and provides the n-th carry signal CR(n) to one of following stages. The n-th stage 132 generates an n-th scan signal SCAN(n) and provides the n-th scan signal SCAN(n) to an n-th gate line.

To this end, the n-th stage 132 includes an input & reset unit BLK1, an inverter BLK2, an output unit BLK3 and a stabilizer BLK4 and may further include a sensing line selector BLK5 for realizing real-time sensing.

The input & reset unit BLK1 charges the Q node with a gate on voltage according to a preceding carry signal CR(n−4) from an (n−4)-th stage and discharges the Q node to a gate off voltage according to a following carry signal CR(n+4) from an (n+4)-th stage. The input & reset unit BLK1 includes a transistor T11 that charges the Q node according to the preceding carry signal CR(n−4) and a transistor T12 that discharges the Q node to a low power supply voltage GVSS (i.e., gate off voltage) according to the following carry signal CR(n+4). The transistor T11 is an input transistor and is diode-connected between the input terminal of the preceding carry signal CR(n−4) and the Q node such that abnormal output, that is, ripples, which may be included in the preceding carry signal CR(n−4) can be effectively discharged. In other words, the gate electrode and the first electrode of the transistor T11 are connected to the input terminal of the preceding carry signal CR(n−4) and the second electrode of the transistor T11 is connected to the Q node. The transistor T12 is a reset transistor, the following carry signal CR(n+4) is applied to the gate electrode of the transistor T12, the first electrode of the transistor T12 is connected to the Q node and the low power supply voltage GVSS is applied to the second electrode of the transistor T12.

The inverter BLK2 charges/discharges the voltage of a QB node according to the voltage of the Q node in a manner reverse to charging/discharging of the Q node. The inverter BLK2 includes a transistor T24 that discharges the QB node to the low power supply voltage GVSS (i.e., gate off voltage) when the Q node is charged with the gate on voltage, transistors T21 to T23 that charge the QB node with the high power supply voltage GVDD (i.e., gate on voltage) when the Q node is discharged to the gate off voltage, and a transistor T25 that discharges the Q node to the low power supply voltage GVSS according to the preceding carry signal CR(n−4). The gate electrode of the transistor T21 is connected to an NX node, the high power supply voltage GVDD is applied to the first electrode of the transistor T21 and the second electrode of the transistor T21 is connected to the QB node. The high power supply voltage GVDD is applied to the gate electrode and the first electrode of the transistor T22 and the second electrode of the transistor T22 is connected to the NX node. The gate electrode of the transistor T23 is connected to the Q node, the first electrode of the transistor T23 is connected to the NX node and the low power supply voltage GVSS is applied to the second electrode of the transistor T23. The gate electrode of the transistor T24 is connected to the Q node, the first electrode of the transistor T24 is connected to the QB node, and the low power supply voltage GVSS is applied to the second electrode of the transistor T24. The preceding carry signal CR(n−4) is input to the gate electrode of the transistor T25, the first electrode of the transistor T25 is connected to the QB node and the low power supply voltage GVSS is applied to the second electrode of the transistor T25.

The output unit BLK3 includes a pull-up transistor T31 that outputs a carry clock CRCLK(n) as a carry signal CR(n) while the Q node is bootstrapped to a voltage higher than the gate on voltage and a pull-up transistor T32 that outputs a scan clock SCCLK(n) as a scan signal SCAN(n). The gate electrode of the pull-up transistor T31 is connected to the Q node, the carry clock CRCLK(n) is input to the first electrode of the pull-up transistor T31, and the second electrode of the pull-up transistor T31 is connected to a first output terminal NO1. The gate electrode of the pull-up transistor T32 is connected to the Q node, the scan clock SCCLK(n) is input to the first electrode of the pull-up transistor T32, and the second electrode of the pull-up transistor T32 is connected to a second output terminal NO2. A booster capacitor Co for bootstrapping may be additionally connected between the gate electrode of the pull-up transistor T32 and the second output terminal NO2.

The stabilizer BLK4 includes a holding transistor T41 which restrains ripples of the second output terminal NO2 and a holding transistor T42 which restrains ripples of the Q node while the QB node is charged with the gate on voltage. That is, the holding transistors T41 and T42 are connected to the second output terminal NO2 and the Q node other than the first output terminal NO1. Any holding transistor is not connected to the first output terminal NO1 such that the stage circuit configuration can be simplified. The holding transistors T41, T42 are electrically isolated from the first output terminal NO1, as no terminal of the holding transistors T41, T42 is connected to the first output terminal NO1.

The holding transistor T41 connects the second output terminal NO2 to the terminal for the low power supply voltage GVSS of the gate off voltage while the gate on voltage is applied to the QB node. The gate electrode of the holding transistor T41 is connected to the QB node and the first electrode and the second electrode of the holding transistor T41 are connected to the second output terminal NO2 and the terminal for the low power supply voltage GVSS.

The holding transistor T42 connects the Q node to the terminal for the low power supply voltage GVSS of the gate off voltage while the gate on voltage is applied to the QB node. The gate electrode of the holding transistor T42 is connected to the QB node and the first electrode and the second electrode of the holding transistor T42 are connected to the Q node and the terminal for the low power supply voltage GVSS.

Figure 12:
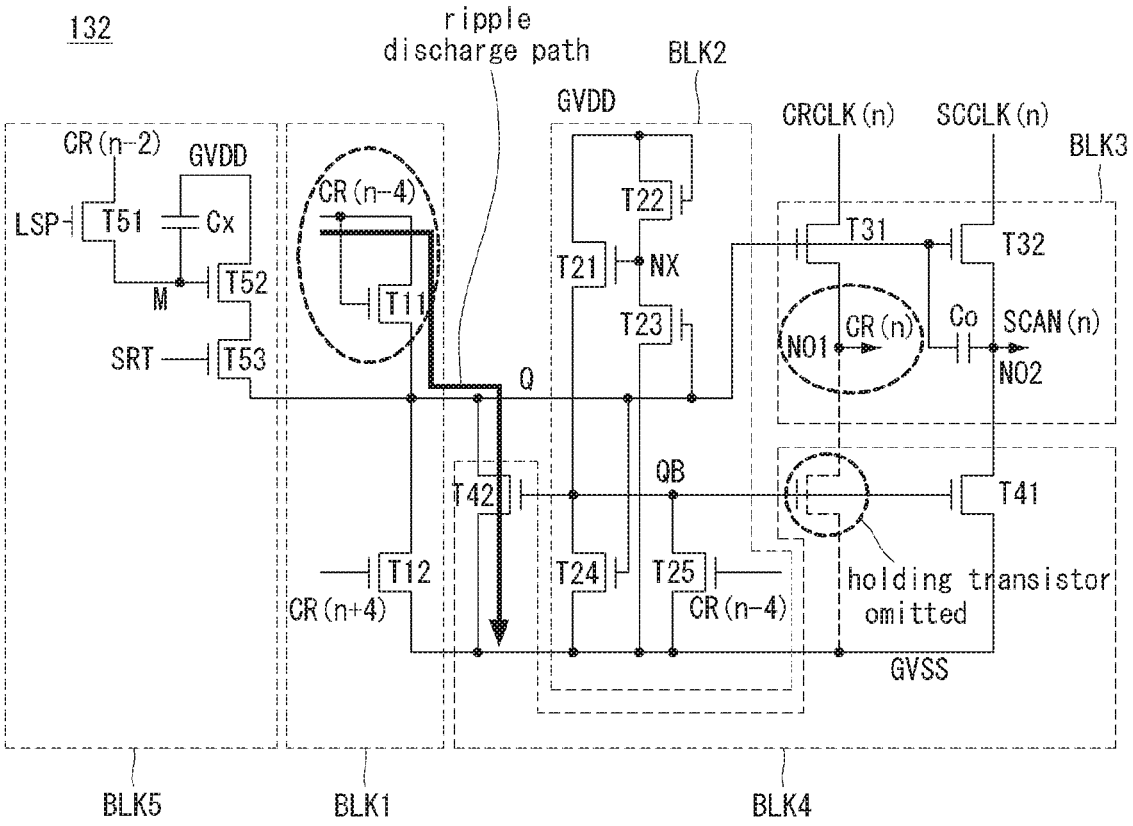
FIG. 12 is a diagram showing complementing a side effect generated when holding transistors are removed from a carry output terminal by applying a diode input structure as a carry input structure.

Since any transistor is not connected to the first output terminal NO1 (e.g., as shown in FIG. 12 as "holding transistor omitted"), ripples may be included in the carry signal CR(n) output from the first output terminal NO1 while the gate on voltage is applied to the QB node due to external circuit interference or the like. Ripple components included in carry signals may be removed through a ripple discharge path shown in FIG. 12. Such a ripple discharge path can be easily realized by connecting the input transistor T11 in a diode mode. That is, a ripple discharge path can be formed between the input terminal of the preceding carry signal CR(n−4) and the Q node and between the Q node and the terminal for the low power supply voltage GVSS while the gate on voltage is applied to the QB node. A ripple component included in the preceding carry signal CR(n−4) of the (n−4)-th stage can be discharged to the terminal for the low power supply voltage GVSS through a ripple discharge path of the n-th stage and thus does not affect carry output and scan output of the n-th stage.

The sensing line selector BLK5 stores a preceding carry signal CR(n−2) input from one (for example, the (n−2)-th stage) of preceding stages at an M node according to a pixel line selection signal LSP and activates the Q node to the gate on voltage according to the voltage of the M node and a sensing start signal SRT. The pixel line selection signal LSP is applied to one (for example, the n-th stage) of the stages during a vertical active period VWP in which image data is written and the sensing start signal SRT is applied to the one stage during a vertical blank period VBP following the vertical active period VWP, in which image data is not written, as show in FIG. 11, such that SDW can be performed for each pixel line for each frame.

The M node of the n-th stage stores the preceding carry signal CR(n−2) according to the pixel line selection signal LSP in the vertical active period VWP to prepare SDW. In addition, the n-th stage activates the Q node to the gate on voltage according to the sensing start signal SRT in the vertical blank period VBP to output the scan signal SCAN (n) for SDW.

In this manner, stages which prepares and performs SDW changes every frame according to the pixel line selection signal LSP and the sensing start signal SRT.

The sensing line selector BLK5 includes a transistor T51 which is turned on according to the pixel line selection signal LSP to apply the preceding carry signal CR(n−2) to the M node, a capacitor Cx which stores the preceding carry signal CR(n−2) applied to the M node, a transistor T52, and a transistor T53. The transistor T52 and the transistor T53 are serially connected between the terminal for the high power supply voltage GVDD of the gate on voltage and the Q node and apply the high power supply voltage GVDD (i.e., the gate on voltage) to the Q node according to the voltage of the M node and the sensing start signal SRT.

A gate driver and an organic light-emitting display device according to various embodiments of the disclosure may be described as follows.

A gate driver comprises a plurality of stages, wherein each of the stages comprises: a first pull-up transistor configured to output a carry clock to a first output terminal as a carry signal while a Q node is bootstrapped to a voltage higher than a gate on voltage; a second pull-up transistor configured to output a scan clock to a second output terminal as a scan signal while the Q node is bootstrapped; and holding transistors operating according to a voltage of a QB node charged and discharged in a manner reverse to the Q node, wherein the holding transistors are connected to the second output terminal and the Q node other than the first output terminal.

The holding transistors comprise: a first holding transistor configured to connect the second output terminal to a low power supply voltage terminal supplying a gate off voltage while the gate on voltage is applied to the QB node; and a second holding transistor configured to connect the Q node to the low power supply voltage terminal while the gate on voltage is applied to the QB node.

Each of the stages further comprises an input transistor for directly applying a preceding carry signal input from one of preceding stages to the Q node to activate the Q node to the gate on voltage.

The input transistor is diode-connected between an input terminal of the preceding carry signal and the Q node.

A gate electrode and a first electrode of the input transistor are connected to the input terminal of the preceding carry signal, and a second electrode of the input transistor is connected to the Q node.

A ripple discharge path is formed between the input terminal of the preceding carry signal and the Q node and between the Q node and the low power supply voltage terminal while the gate on voltage is applied to the QB node.

Each of the stages further comprises a sensing line selector configured to store a preceding carry signal input from one of preceding stages at an M node according to a pixel line selection signal and activating the Q node to the gate on voltage according to the voltage of the M node and a sensing start signal.

The pixel line selection signal is applied to one of the stages during a vertical active period in which image data is written in one frame.

The sensing start signal is applied to the one stage during a vertical blank period following the vertical active period, in which image data is not written.

The sensing line selector comprises: a first transistor turned on according to the pixel line selection signal to apply the preceding carry signal to the M node; a capacitor storing the preceding carry signal applied to the M node; and second and third transistors serially connected between a high power supply voltage terminal supplying the gate on voltage and the Q node to apply the gate on voltage to the Q node according to the voltage of the M node and the sensing start signal.

An organic light-emitting display device comprises a gate driver and a plurality of pixels connected to the gate driver through gate lines.

The present disclosure can simplify stage circuits to reduce a bezel area by removing holding transistors from carry output terminals of the stages constituting the gate shift register. Accordingly, the number of transistors is reduced to decrease a failure rate and improve production yield.

The present disclosure can form a discharge path in a stage by applying a diode input structure as a carry input structure to complement a side effect caused by removal of holding transistors from carry output terminals.

The present disclosure can further simplify the stage circuit configuration to further reduce the bezel area by simultaneously controlling the first pull-up transistor which outputs a carry signal and the second pull-up transistor which outputs a scan signal using the same Q node in each of the stages constituting the gate shift register.

The present disclosure can easily realize real-time sensing by including the sensing line selector in the stages constituting the gate shift register.

The effects of the present disclosure are not limited to the above description and various effects are included in the specification.

Those skilled in the art will appreciate that various modifications and variations can be made in the present disclosure without departing from the spirit or scope of the disclosure through the above description. Accordingly, the technical scope of the present disclosure should not be limited to the detailed description of the specification but should be determined by the claims.

The various embodiments described above can be combined to provide further embodiments. These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A gate driver, comprising:

a plurality of stages, each of the stages including:

a first pull-up transistor configured to output a carry clock to a first output terminal as a carry signal while a Q node is bootstrapped to a voltage higher than a gate on voltage;

a second pull-up transistor configured to output a scan clock to a second output terminal as a scan signal while the Q node is bootstrapped; and holding transistors configured to operate based on a voltage of a QB node, the QB node configured to be charged and discharged in a manner reverse to charging and discharging of the Q node, and a sensing line selector configured to store a first preceding carry input signal from a first preceding one of the stages at an M node according to a pixel line selection signal and to activate the Q node to the gate on voltage according to a voltage of the M node and a sensing start signal, wherein the holding transistors are connected to the second output terminal and the Q node, and the holding transistors are electrically isolated from the first output terminal.

2. The gate driver of claim 1, wherein the holding transistors comprise:

a first holding transistor configured to connect the second output terminal to a low power supply voltage terminal supplying a gate off voltage while the gate on voltage is applied to the QB node; and a second holding transistor configured to connect the Q node to the low power supply voltage terminal while the gate on voltage is applied to the QB node.

3. The gate driver of claim 2, wherein each of the stages further includes an input transistor for directly applying a second preceding carry signal input from a second preceding one of the plurality of stages to the Q node to activate the Q node to the gate on voltage.

4. The gate driver of claim 3, wherein the input transistor is diode-connected between an input terminal of the second preceding carry signal and the Q node.

5. The gate driver of claim 4, wherein a gate electrode and a first electrode of the input transistor are connected to the input terminal of the second preceding carry signal, and a second electrode of the input transistor is connected to the Q node.

6. The gate driver of claim 5, wherein a ripple discharge path is formed between the input terminal of the second preceding carry signal and the Q node and between the Q node and the low power supply voltage terminal while the gate on voltage is applied to the QB node.

7. The gate driver of claim 1, wherein the pixel line selection signal is applied to one of the stages during a vertical active period in which image data is written in one frame.

8. The gate driver of claim 7, wherein the sensing start signal is applied to the one stage during a vertical blank period following the vertical active period, in which image data is not written.

9. The gate driver of claim 1, wherein the sensing line selector comprises:

a first transistor that is turned on according to the pixel line selection signal to apply the first preceding carry signal to the M node;

a capacitor storing the first preceding carry signal applied to the M node; and second and third transistors serially connected between a high power supply voltage terminal supplying the gate on voltage and the Q node, the second and third transistors configured to apply the gate on voltage to the Q node according to the voltage of the M node and the sensing start signal.

10. An organic light-emitting display device, comprising:

a gate driver having a plurality of stages, each of the stages including:

a first pull-up transistor configured to output a carry clock to a first output terminal as a carry signal while a Q node is bootstrapped to a voltage higher than a gate on voltage;

a second pull-up transistor configured to output a scan clock to a second output terminal as a scan signal while the Q node is bootstrapped; and holding transistors configured to operate based on a voltage of a QB node, the QB node configured to be charged and discharged in a manner reverse to charging and discharging of the Q node, the holding transistors being connected to the second output terminal and the Q node, the holding transistors being electrically isolated from the first output terminal; and a sensing line selector configured to store a first preceding carry signal input from a first preceding one of the stages at an M node according to a pixel line selection signal and to activate the Q node to the gate on voltage according to a voltage of the M node and a sensing start signal; and a plurality of pixels connected to the gate driver through a plurality of gate lines.

11. The organic light-emitting display device of claim 10, wherein the holding transistors comprise:

a first holding transistor configured to connect the second output terminal to a low power supply voltage terminal supplying a gate off voltage while the gate on voltage is applied to the QB node; and a second holding transistor configured to connect the Q node to the low power supply voltage terminal while the gate on voltage is applied to the QB node.

12. The organic light-emitting display device of claim 11, wherein each of the stages further includes an input transistor for directly applying a second preceding carry signal input from a second preceding one of the plurality of stages to the Q node to activate the Q node to the gate on voltage.

13. The organic light-emitting display device of claim 12, wherein the input transistor is diode-connected between an input terminal of the second preceding carry signal and the Q node.

14. The organic light-emitting display device of claim 13, wherein a gate electrode and a first electrode of the input transistor are connected to the input terminal of the second preceding carry signal, and a second electrode of the input transistor is connected to the Q node.

15. The organic light-emitting display device of claim 14, wherein a ripple discharge path is formed between the input terminal of the second preceding carry signal and the Q node and between the Q node and the low power supply voltage terminal while the gate on voltage is applied to the QB node.

16. The organic light-emitting display device of claim 10, wherein the pixel line selection signal is applied to one of the stages during a vertical active period in which image data is written in one frame.

17. The organic light-emitting display device of claim 16, wherein the sensing start signal is applied to the one stage during a vertical blank period following the vertical active period, in which image data is not written.

18. The organic light-emitting display device of claim 10, wherein the sensing line selector comprises:

a first transistor that is turned on according to the pixel line selection signal to apply the first preceding carry signal to the M node;

a capacitor storing the first preceding carry signal applied to the M node; and second and third transistors serially connected between a high power supply voltage terminal supplying the gate on voltage and the Q node, the second and third transistors configured to apply the gate on voltage to the Q node according to the voltage of the M node and the sensing start signal.

* * * * *